US005373937A

United States Patent [19]

Lamboy

[11] Patent Number: 5,373,937

[45] Date of Patent: Dec. 20, 1994

[54] TWO-COMPARTMENT CONTAINER

[75] Inventor: Peter Lamboy, Weiterstadt, Germany

[73] Assignee: Goldwell AG, Darmstadt, Germany

[21] Appl. No.: 255,350

[22] Filed: Jun. 8, 1994

[30] Foreign Application Priority Data

Jul. 16, 1993 [DE] Germany ..... 4323841

[51] Int. Cl.[5] ..... B65D 25/08; B65D 81/32

[52] U.S. Cl. ..... 206/221; 215/DIG. 8

[58] Field of Search ..... 206/219, 221, 220; 215/DIG. 8, 216, 317

[56] References Cited

U.S. PATENT DOCUMENTS

| | | | |
|---|---|---|---|
| 2,807,384 | 9/1957 | Liposi | 206/221 X |
| 2,813,649 | 11/1957 | Liposi | 206/221 X |
| 3,651,990 | 3/1972 | Cernei | 206/221 X |
| 4,727,985 | 3/1988 | McNeirney et al. | 215/DIG. 8 X |
| 4,993,592 | 2/1991 | Brader | 206/221 X |

FOREIGN PATENT DOCUMENTS 0745932 5/1933 France .

*Primary Examiner*—Jacob K. Ackun, Jr.

[57] ABSTRACT

The invention relates to a two-compartment container of simple construction in one piece [as a whole], comprising two compartments stacked one upon another, which are connected by a passage opening. The passage opening is sealed by a stopper, and a closing cap which is fitted on top of the upper chamber and which partly embraces the outer wall of the same. The stopper has a connecting element which reaches into the upper chamber and has an end that is shaped as a rectangular or disk part. Underneath the end part, hook-shaped and contoured supports snap in, forming the lower end of a handle which has an enlargement on its upper end that protrudes from the container. The handle is connected to the closure cap in one piece by an elastic membrane which is turned in to the inside as long as the chamber is closed, and turned outside when the stopper is removed.

4 Claims, 1 Drawing Sheet

TWO-COMPARTMENT CONTAINER

BACKGROUND OF THE INVENTION

1. Field of the Invention

This invention comprises a new two-compartment container with a simplified construction in comparison with known two-compartment packs, but having improved functional performance.

Two-compartment containers are known since a long time in various embodiments; particularly, they are used for packaging cosmetic compositions containing ingredients which must be kept separately until application, because otherwise they would react with each other.

2. The Prior Art

Reference is, e.g., made to the two-compartment container according to German Patent Application 35 28 525, comprising two separately fillable chambers upon one another, which are separated from each other by a separating element which may be opened by an externally operated tappet actuating element, the separating element forming at least part of the bottom wall of the upper chamber and sealing the lower chamber, so that the components can adjoin and are miscible, whereby the separating element is constructed as a closing stopper which is sealing the passage opening between the upper and the lower chamber, thus allowing vertical movement of the enclosing tappet actuating element from the passage opening into one of the chambers. An improved development of such a two-compartment container represents the two-compartment container described in German Patent Application 38 12 343, the passage opening of which is closed by a separating stopper between two container chambers which are stacked upon each other, and wherein the separating stopper is connected to a tappet actuating element which is designed as an elongated hollow application nozzle reaching from the upper chamber to its open mouthpiece, where the tappet actuating element, on its outside, has an external thread gearing with a complementary internal thread which is constructed with an attached screw cap partly including a cylindrical ring-shaped projection, fitted turnable on the same and sealing the cheer from the front end at its open upper side. When turning the screw cap in the sense of screwing in the application nozzle into this ring-shaped projection, the free end of the application nozzle can be pushed through the front opening.

German Patent Application 36 11 925 discloses a waist-shaped bottle with a stopper which is placed in the waisted part of the bottle to divide the bottle into two separate cheers, which are connectible by pressing the stopper from the waisted level into the chamber opposite the bottle closure, constructed so that both cheers have a relatively big volume to allow different filling proportions for the mixing ratio, but wherein the components to be admixed are safely combined. This is realized by the fact that a bar connection is constructed between the stopper and the bottle closure attached to the screw thread so that the screw cap has an impact collar sitting on the front end of the connecting bar.

All these two-compartment containers are suitable packaging systems, being also in practical use. However, their construction is relatively complicated as they consist of many single components which make production and packaging rather expensive.

SUMMARY OF THE INVENTION

The present invention, therefore, starts with the problem of developing a two-compartment container having a separating stopper for sealing two single compartments which are kept separate until application; production and packaging of the container should be a simple process, it should have few single components, but still allow safe separation of the products to be kept apart until application, and in the event of usage, allow reliable mixing of the components and discharge of the mixture.

According to the invention, this problem is solved by a two-compartment container consisting of an upper and a lower part being moulded in one piece, the compartments being separated by a stopper fixed at the junction point of both components according to the features described below.

BRIEF DESCRIPTION OF THE DRAWINGS

The FIGS. 1 and 2 illustrate the container according to the invention.

DETAILED DESCRIPTION OF THE DRAWINGS

Figure 2:
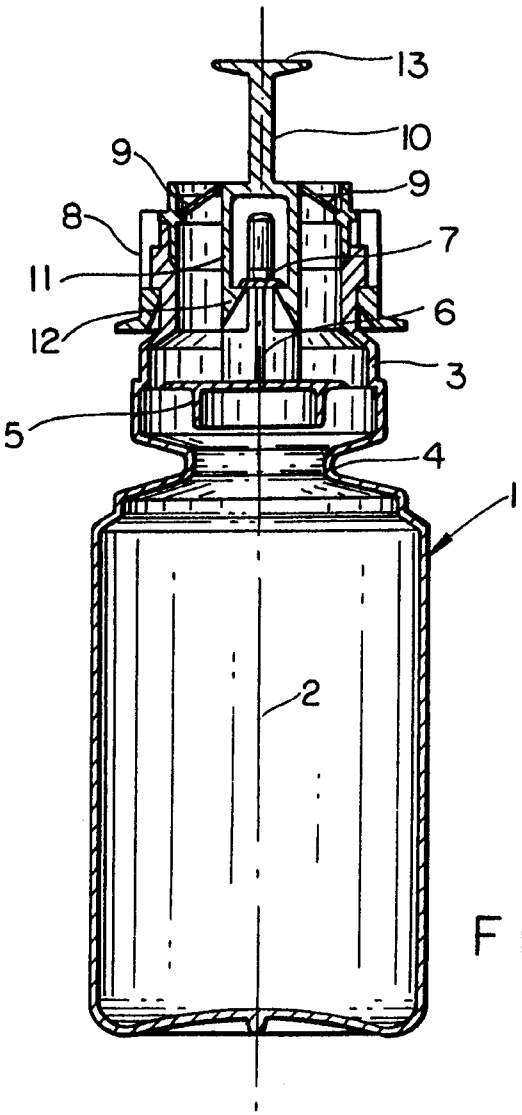
FIG. 2 is a sectional view of the container of the present invention when opened.
Figure 1:
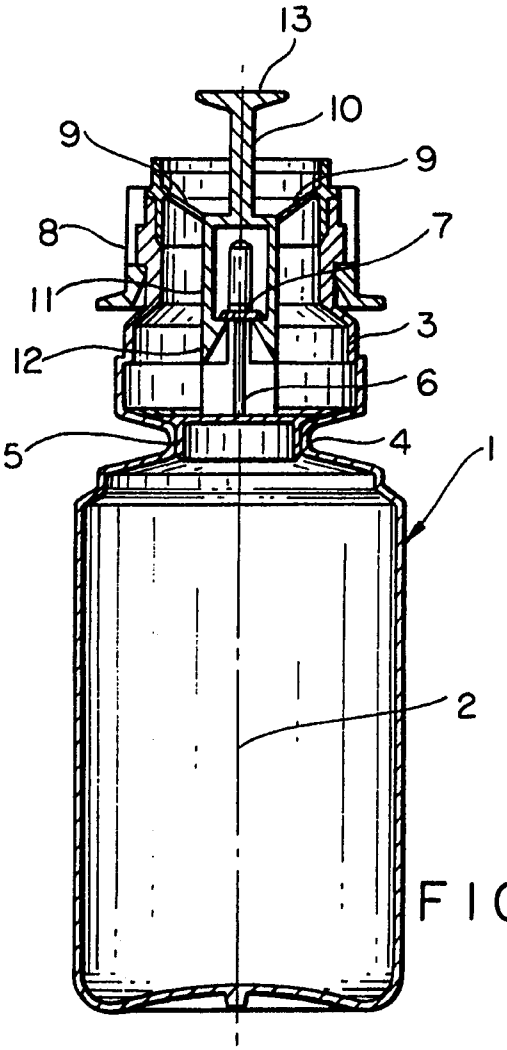
FIG. 1 is a sectional view of the container of the present invention in its sealed state.

Referring now to the drawings, the two-compartment container (1), moulded in one piece, comprises two cheers (2) and (3) which are stacked one upon another and which are connected by an opening passage (4) at a level having preferably a reduced diameter compared with the total extent of the container. This passage opening (4) is sealed by a stopper (5) joined to a coupling link (6) reaching into the upper cheer (3) and having on its end a disk-shaped plate or rectangular part, e.g. a square (7), which is preferably undercut.

The outer wall of the upper container (3) is partly embraced by a screw cap (8) which is removed for application of the ready-to-use mixture. This screw cap (8) is linked by an elastic membrane (9) connected to a handle (10), the lower portion (11) of which extends into the upper compartment (3) of the container, is shaped like a hook (12) and is placed under the upper part (7) of the coupling link (6). The upper part of the handle (10) protuding from the container (1) has an enlarged end (13) to allow removal of the stopper (5).

Application of the product is effected by the following procedure:

The enlarged end (13) of the handle (10) is drawn upward whereby the elastic membrane (9) is turned outside; by the action of the hook-shaped lower end (12) of the handle (10) onto the upper disk-shaped or rectangular end (7) of the coupling link (6), the stopper (5) is pulled out from the passage opening (4), whereby the contents of the different chambers (2) and (3) are mixed and may be discharged from the container. Thereby, a reliable two-compartment system is provided although the number of single parts is low and thus the construction of the container is simple and its production is cheap.

The filling and packaging of the two-compartment container according to the invention is performed in a conceivably uncomplicated process: First, the lower chamber (2) is filled with a solution, emulsion, dispersion, etc., then the passage opening (4) is sealed by the stopper (5), the upper chamber (3) is filled, and thereafter the screw cap (8) is attached with its integrated parts thereby sealing the total container (1).

The two-compartment container according to the invention can principally be used for packaging any type of product consisting of two compositions which require separate storage until application.

The two-compartment system according to the invention is preferably used for the packaging of cosmetics, e.g., hair cosmetics. Suitable products are hair dyes, preferably on the basis of oxidation hair dyes, comprising oxidation hair dye-precursors on the one hand and the oxidizing agent on the other hand; also permanent waving compositions, e.g., those on the basis of glycerol monothioglycollate, which must be kept separate from the aqueous remainder of the total composition until application, may be stored and delivered by this novel container.

The two-compartment packaging according to the invention consists preferably of plastic material, e.g., polyethylene, polypropylene, polyester, and polyamide.

A preferred material is a polyester/polyamide coextrudate; the screw cap with its integrated elastic membrane is preferably made of polyethylene, the same applies to the stopper. I do not limit myself to any particular details of construction set forth in this specification and illustrated in the accompanying drawings, as the same refers to and sets forth only certain embodiments of the invention, and it is observed that the same may be modified without departing from the spirit and scope of the claimed invention.

Having thus described the invention, what is claimed as new and desire to be secured by Letters Patent is as follows:

I claim:

1. A two-compartment container (1) including two chambers (2), one of said two chambers being an upper chamber which is stacked on top of another of said two chambers, a passage opening (4) connecting said two chambers, a stopper (5) which closes said passage opening, having a screw cap (8) which is attached to said upper chamber (3), which partly embraces an outer wall of said upper chamber (3), comprising:

a) said stopper (5) includes a coupling link (6) extending into said upper chamber (3), said coupling link (6) having an end shaped as a disk or a rectangular unit;

b) hook-shaped and contoured supports (12) that snap into an underside of said end part of said coupling link to form a lower end of a handle (10) which has an enlargement (13) on its upper end protruding from the container (1); and c) the handle (10) being connected to the screw cap (8) in one piece by an elastic membrane (9), which is turned inside as long as the chamber is closed, and turns outside after the stopper is removed.

2. The two-compartment container according to claim 1, wherein the disk-shaped or rectangular end (7) of the coupling link (6) which is connected with the stopper (5) is undercut to catch the hook-shaped supports (12).

3. The two-compartment container according to claim 1, wherein the container (1) has a reduced diameter in the region of the passage opening (4) between the chambers (2) and (3) related to the total diameter of the container (1).

4. The two-compartment container according to claim 2, wherein the container (1) has a reduced diameter in the region of the passage opening (4) between the chambers (2) and (3) related to the total diameter of the container (1).

* * * * *